US008767980B2

(12) United States Patent
Statham

(10) Patent No.: US 8,767,980 B2
(45) Date of Patent: Jul. 1, 2014

(54) OMNIDIRECTIONAL BUTTON-STYLE MICROPHONE

(75) Inventor: Kelly Statham, Cleveland, OH (US)

(73) Assignee: CAD Audio, LLC, Solon, OH (US)

( * ) Notice: Subject to any disclaimer, the term of this patent is extended or adjusted under 35 U.S.C. 154(b) by 415 days.

(21) Appl. No.: 13/053,937

(22) Filed: Mar. 22, 2011

(65) Prior Publication Data

US 2011/0228957 A1 Sep. 22, 2011

Related U.S. Application Data

(60) Provisional application No. 61/316,147, filed on Mar. 22, 2010.

(51) Int. Cl.
*H04R 3/00* (2006.01)

(52) U.S. Cl.
USPC ..... 381/113; 381/111; 381/106; 381/120

(58) Field of Classification Search
CPC ..... H04R 19/00; H04R 19/04; H04R 19/016; H04R 3/00; H03G 7/00
USPC ..... 381/113, 111, 122, 150, 174, 104, 381/106–107, 120
See application file for complete search history.

(56) References Cited

U.S. PATENT DOCUMENTS 4,000,370 A * 12/1976 Smith et al. ..... 381/104
4,312,060 A * 1/1982 Grodinsky ..... 369/134
4,661,981 A * 4/1987 Henrickson et al. ..... 704/224
6,266,423 B1 7/2001 Werrbach
2003/0063024 A1* 4/2003 Cerra ..... 341/155
2006/0147060 A1* 7/2006 Shyu et al. ..... 381/113
2007/0229123 A1* 10/2007 Hsiao ..... 327/111

OTHER PUBLICATIONS

"Extron Glossary of Terms." Extron Electronics. 2007. Web. <http://www.extron.com/technology/glossary.aspx?id=N>.*
"Crossover Basics." Basic Car Audio Electronics. 2004. Web. <http://www.bcae1.com/xovrslop.htm>.*
"Hearing Range." Wikipedia. 2008. Web. <http://en.wikipedia.org/wiki/Hearing_range>.*
"Dynamic range compression." Wikipedia. 2008. Web. <http://en.wikipedia.org/wiki/Dynamic_range_compression>.*
"210 Premium Omnidirectional Button Style Microphone with Adjustable Line-Level." CAD Audio. Jan. 2010. Web.*
Title of Article: Basic Compressor/Limiter Design Publication Name: THAT Corporation Design Note 00A (formerly Application Note 100A) pp. 1-7 Issue No. 600135 Revision 01.
Title of Article: Pre-trimmed Low-voltage Low-power Analog Engine Dynamics Processor IC Publication Name: THATCorporation THAT 4320 pp. 1-16 Issue No. 600045 Revision 06 Date: Copyright 2009.

(Continued)

*Primary Examiner* — Joseph Saunders, Jr.
*Assistant Examiner* — James Mooney
(74) *Attorney, Agent, or Firm* — Emerson Thomson Bennett, LLC; Roger D. Emerson; Sergey Vernyuk

(57) ABSTRACT

A microphone can include a capacitor capsule, an output buffer amplifier connected to the output of the capacitor capsule, and an audio limiter connected to the output of the output buffer amplifier, wherein the audio limiter limits the output level of the microphone at a threshold level. The microphone can include an adjustable output level. The microphone can include an integrated high-pass filter. The microphone can have an omnidirectional polar pattern.

19 Claims, 9 Drawing Sheets

(56) References Cited

OTHER PUBLICATIONS

Title of Article: Simple Optocoupler Limiter Publication Name: Silonex the Art of Micro-Engineering Document: Limitr2.SCH pp. 1-2 Date: Mar. 12, 2001.

Title of Article: Audio Limiter pp. 1-6 website: www.dicks-website.eu/limiter/enindex.html Author: Dick Kleijer Country: Netherlands.

Title of Article: VCA-Controlled 1st Order State Variable Filter Publication Name: THAT Corporation Design Note 130 Document No. 600163 Revision 01 p. 1-6 Date: Copyright 2001-2010.

Title of Article: A Fully Adjustable Noise Gate Publication Name: THAT Corporation Design Note 100 Document No. 600144 Revision 01 p. 1-3 Date: Copyright 2001-2009.

* cited by examiner

OMNIDIRECTIONAL BUTTON-STYLE MICROPHONE

CROSS-REFERENCE TO RELATED APPLICATIONS

This application claims the benefit of U.S. Provisional Application No. 61/316,147, titled OMNIDIRECTIONAL BUTTON-STYLE MICROPHONE, filed Mar. 22, 2010, which is herein incorporated by reference.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC

Not Applicable.

BACKGROUND OF THE INVENTION

1. Field of the Invention

The present invention relates generally to microphones and more specifically to microphone electronics and circuitry.

2. Description of Related Art

It is known in the art to provide a microphone for security, ambient monitoring, and observation applications. Typical sound and video monitors and recorders used in the art are equipped with line-level inputs only, requiring the use of external microphone pre-amplification. If the pre-amplifier gain is adjusted high enough such that quiet or distant sound sources are resolved adequately, closer and/or louder sounds can significantly distort the recording or monitoring device. An audio dynamic-range compressor or limiter may be added between the pre-amplifier and recording or monitoring equipment to manage this condition.

Therefore, what is needed is a microphone which includes a dynamic-range compressor or limiter, an output-level control, and a line-level capable output.

BRIEF SUMMARY OF THE INVENTION

According to one embodiment of this invention, a microphone includes: a capacitor capsule; an output buffer amplifier connected to the output of the capacitor capsule; and an audio limiter connected to the output of the output buffer amplifier, wherein the audio limiter limits the output level of the microphone at a threshold level. The output level of the microphone can be adjustable. The output level can be adjustable from about −50 dBV (3.2 mV) to about −10.5 dBV (300 mV) @ 1 μBar. The microphone can further include an integrated high-pass filter. The integrated high-pass filter can be a 100 Hz, 12 dB/oct high-pass filter. The microphone can have an omnidirectional polar pattern. The threshold level can be fixed or adjustable.

According to another embodiment, a microphone includes a microphone capsule; a low-noise preamplifier operatively connected to the microphone capsule; a high-pass filter operatively connected to the low-noise preamplifier; a voltage controlled amplifier operatively connected to the low-noise preamplifier; an RMS detector operatively connected to the voltage controlled amplifier; a limiter threshold detector operatively connected to the voltage controlled amplifier and the RMS detector; and an output buffer amplifier operatively connected to the voltage controlled amplifier. In some embodiments, the output of the limiter threshold detector decreases when the output level of the RMS detector exceeds a set level, wherein the decrease in the output of the limiter threshold detector reduces the gain of the voltage controlled amplifier and maintains the output of the voltage controlled amplifier at a fixed level. The microphone capsule can be permanently biased and include an FET impedance converter. The microphone can include a noise filter for the FET impedance converter.

According to another embodiment, a method of limiting the output of a microphone at a predetermined level can include the following steps: providing a microphone comprising a microphone capsule, a low-noise preamplifier operatively connected to the microphone capsule, a high-pass filter operatively connected to the low-noise preamplifier, a voltage controlled amplifier operatively connected to the low-noise preamplifier, an RMS detector operatively connected to the voltage controlled amplifier, a limiter threshold detector operatively connected to the voltage controlled amplifier and the RMS detector, and an output buffer amplifier operatively connected to the voltage controlled amplifier; decreasing the output of the limiter threshold detector when the output level of the RMS detector exceeds a set level; and reducing the gain of the voltage controlled amplifier maintaining the output of the voltage controlled amplifier at a fixed level.

One advantage of this invention is the microphone can receive sound in a broad decibel range and not overload subsequent equipment when the received sound exceeds beyond a predetermined decibel level.

Still other benefits and advantages of the invention will become apparent to those skilled in the art to which it pertains upon a reading and understanding of the following detailed specification.

BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

DETAILED DESCRIPTION OF THE INVENTION

Figure 1:
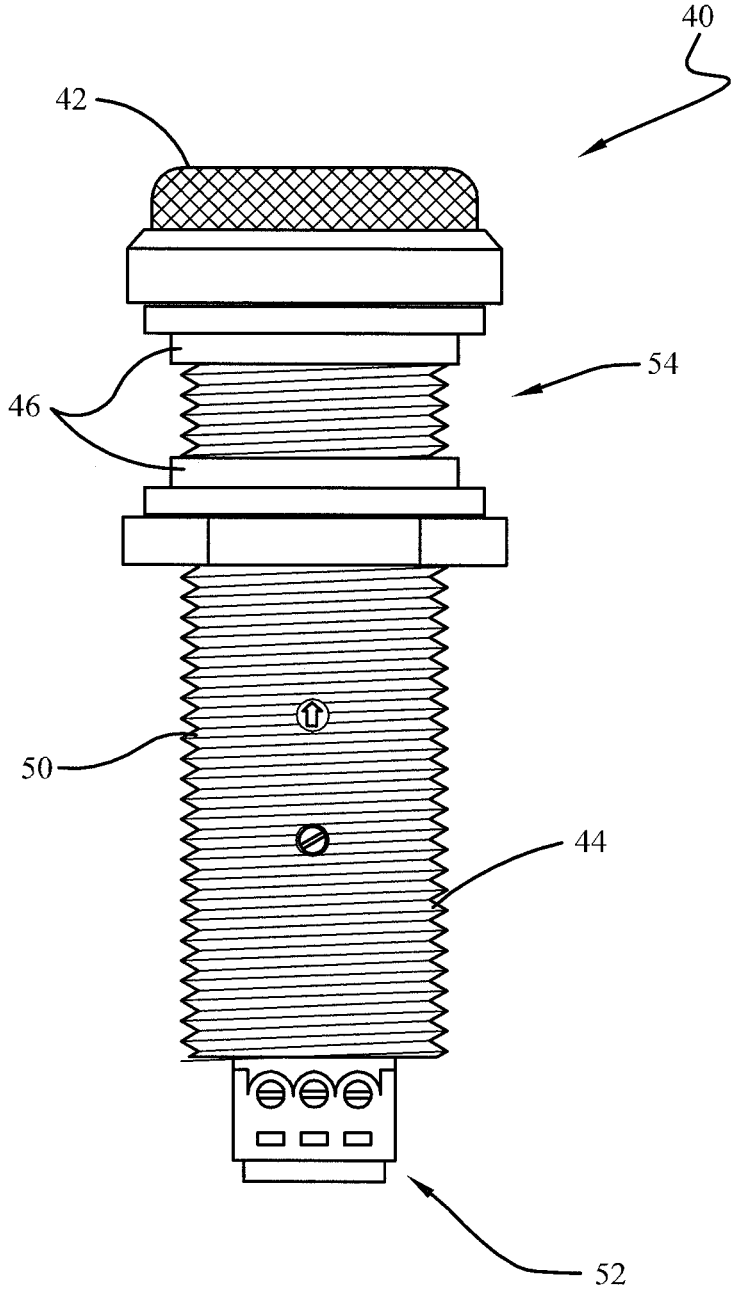
FIG. 1 is a perspective side view of a microphone, according to one embodiment.
Figure 2:
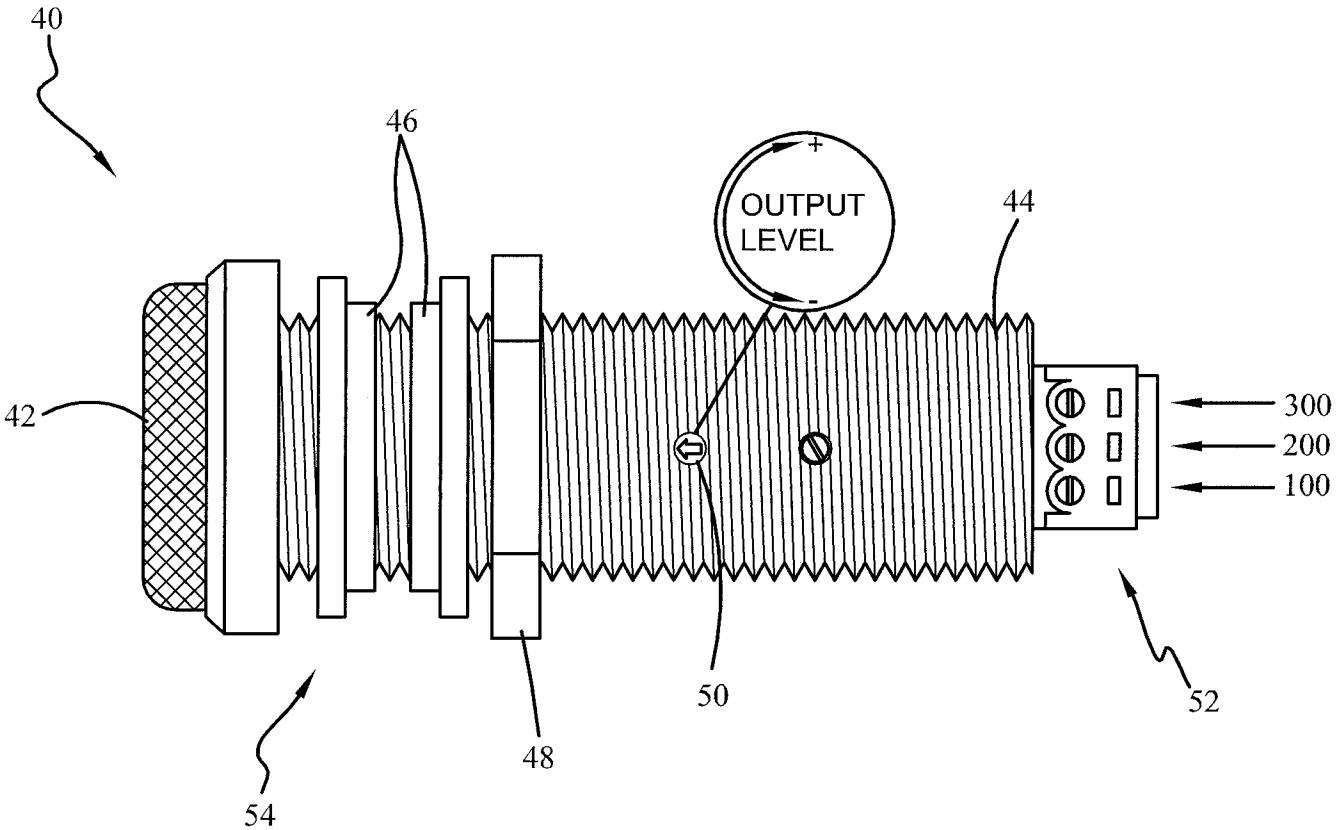
FIG. 2 is a perspective side view of a microphone illustrating the output-level control and terminal block connector, according to one embodiment.
Figure 3:
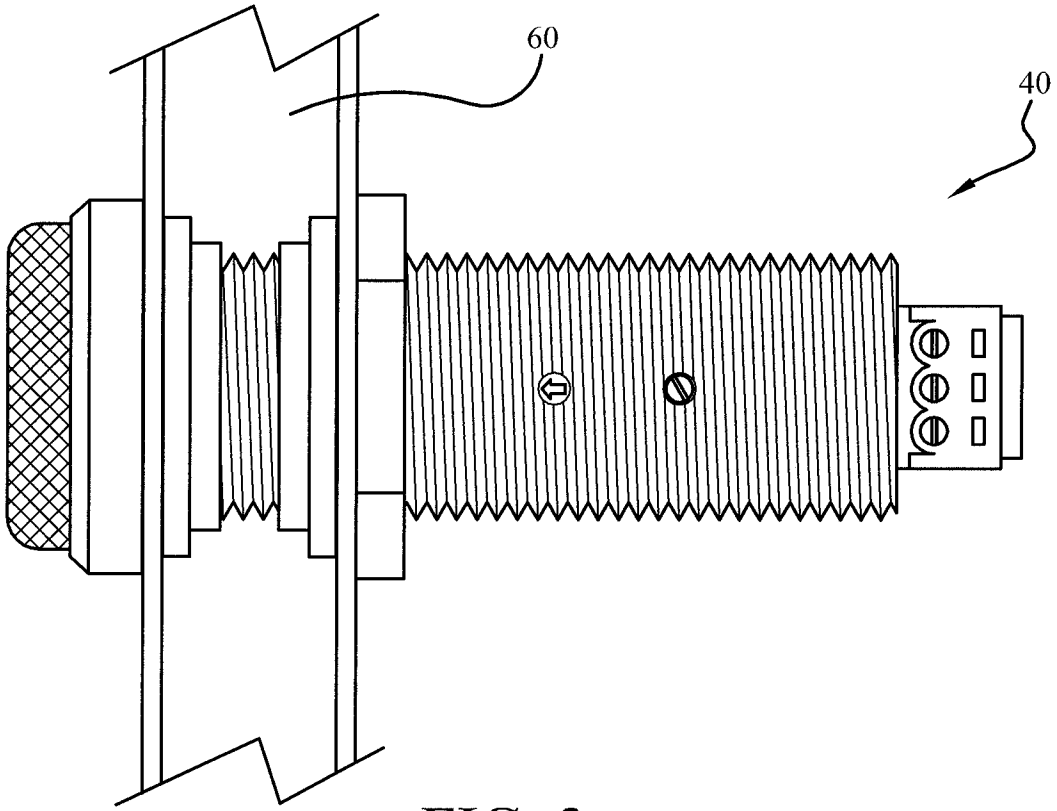
FIG. 3 is a side view a microphone installed in a wall or ceiling, according to one embodiment.
Figure 4:
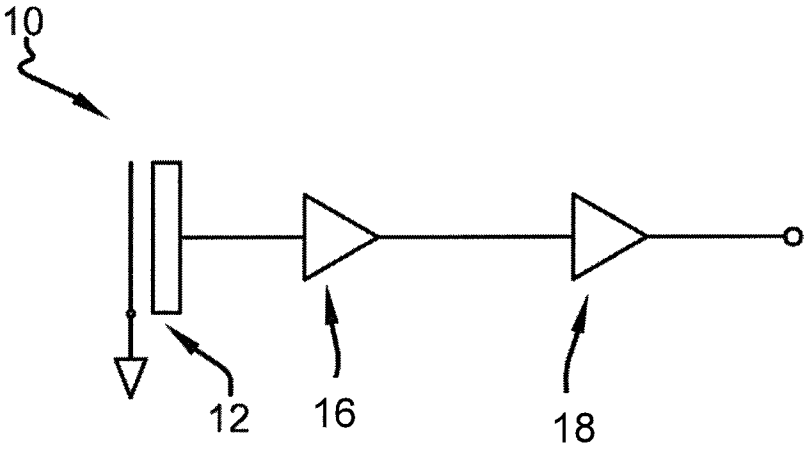
FIG. 4 is schematic diagram of a microphone circuit, according to one embodiment.
Figure 5:
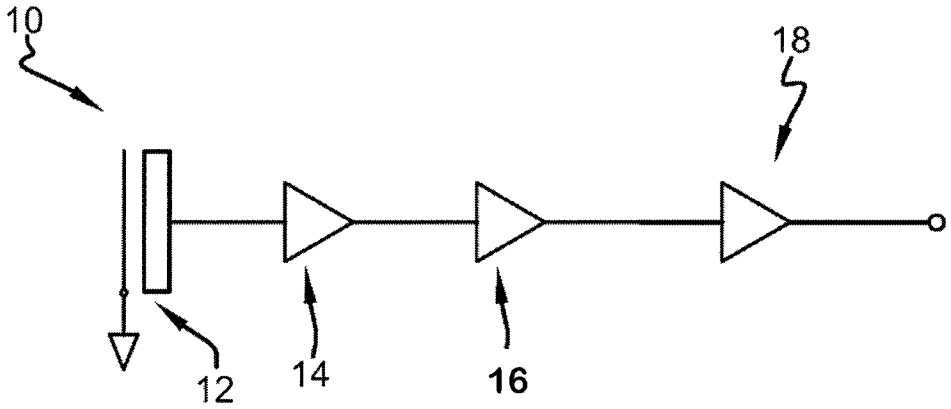
FIG. 5 is schematic diagram of a microphone circuit, according to one embodiment.
Figure 6:
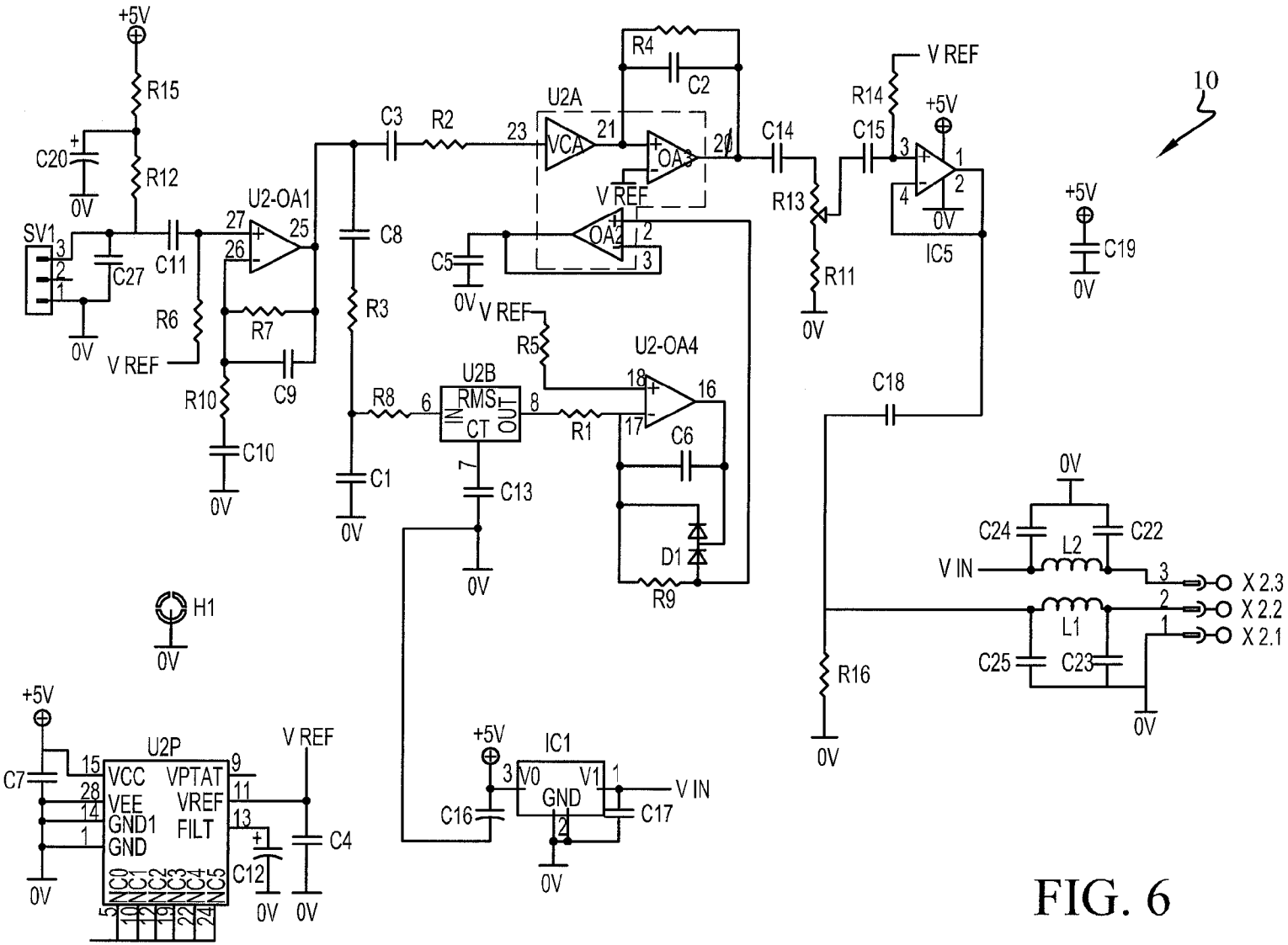
FIG. 6 is circuit diagram of a microphone, according to one embodiment.

Referring now to the drawings wherein the showings are for purposes of illustrating embodiments of the invention only and not for purposes of limiting the same, and wherein like reference numerals are understood to refer to like components, FIGS. 1-3 show a microphone 40 which can include a microphone circuit 10, shown in FIGS. 4-6. The microphone 40 can include a microphone head 42, a threaded housing 44, one or more bushings 46, a nut 48, an output-level control 50, and a removable terminal block connector 52. The microphone 40 can include an adjustable line-level output. In some embodiments, the output-level control 50 can be integrated. In one embodiment, the output-level control 50 can adjust or vary the output level of the microphone 40 from about −50 dBV (3.2 mV) to about −10.5 dBV (300 mV) @ 1 μBar. The adjustable line-level output level is designed to interface with security cameras, digital video recorders, and other observation and recording devices. The bushings 46 can be shock-absorbing polymer bushings. The microphone 40 can include an integrated high-pass filter 54 for improved intelligibility and voice articulation. In one embodiment, the integral high-pass filter 54 is a 150 Hz, 6 dB/oct high-pass filter. In another embodiment, the integral high-pass filter 54 is a 100 Hz, 12 dB/oct high-pass filter.

With continuing reference to FIGS. 1 and 2, the terminal block connector 52 can be a removable 3.5 mm terminal block plug with a terminal block accepting 30 AWG to 14 AWG wire. The terminal block connector 52 can include three terminals: the first terminal 100 connects to the ground; a second terminal 200 provides the output signal; and a third terminal 300 accepts external power. The output signal can be an unbalanced, amplified signal. The microphone can be powered by a DC power source. In one embodiment, the microphone 40 can be powered by an 8 to 18 VDC, 70 mA source. In another embodiment, the microphone 40 can be powered by a 9 to 28 VDC, 70 mA source. The maximum SPL of the microphone 40 can be 110 dB in one embodiment, or 100 dB in another embodiment.

Figure 8:
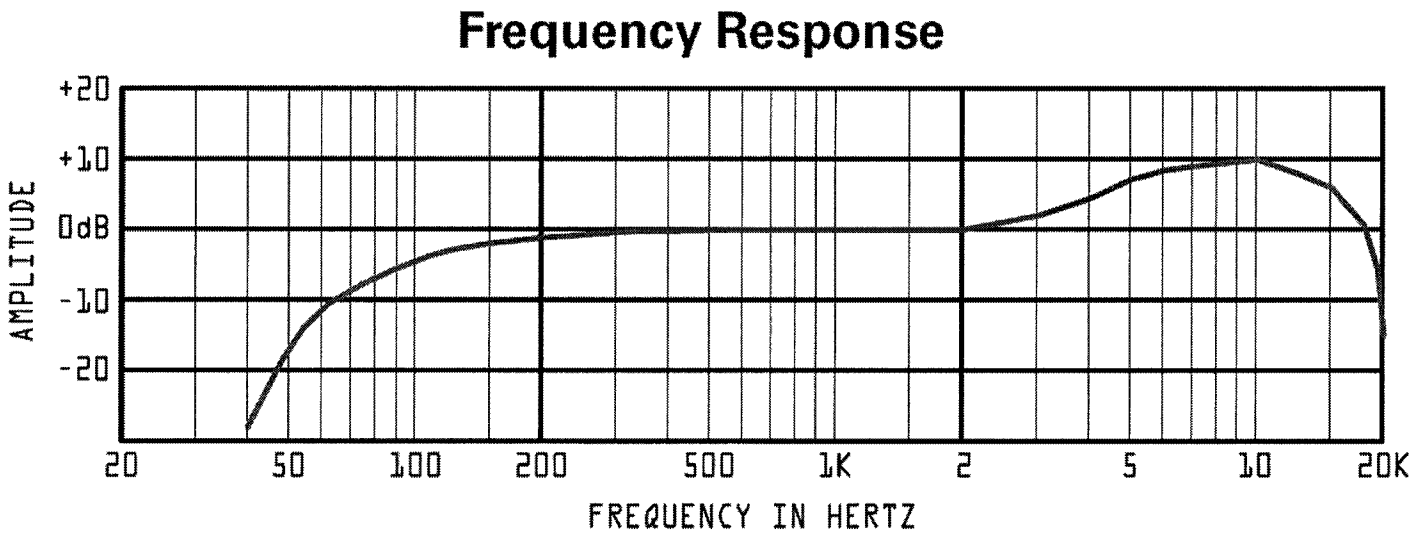
FIG. 8 is a graph of a frequency response of a microphone, according to one embodiment.
Figure 9:
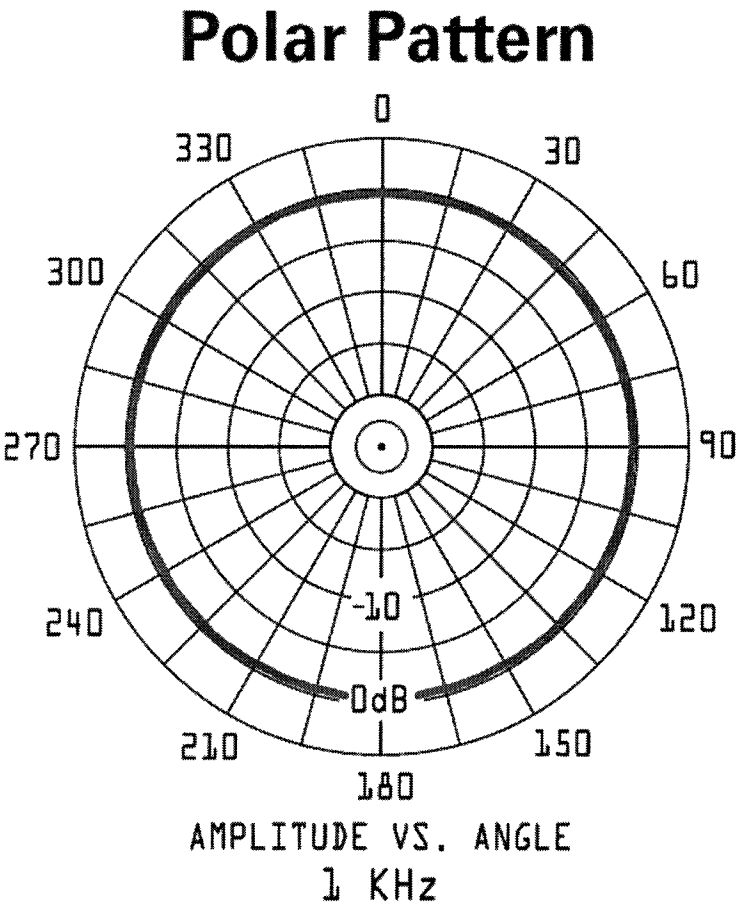
FIG. 9 is a graph of a polar pattern of a microphone, according to one embodiment.

According to some embodiments, the microphone 40 is a condenser microphone, also called a capacitor microphone or electrostatic microphone, with an omnidirectional polar pattern. The microphone 40 can include a permanently-biased condenser. FIG. 9 illustrates a polar pattern of the microphone 40, according to some embodiments. The microphone 40 can have a frequency response of about 120 Hz to about 18 KHz. FIG. 8 illustrates a frequency response of the microphone 40, according to some embodiments.

According to one embodiment, the microphone 40 can include: a condenser; an omnidirectional polar pattern; a frequency response of from about 120 Hz to about 18 KHz; an adjustable sensitivity from about −50 dBV (3.2 mV) to about −10.5 dBV (300 mV) @ 1 μBar; an impedance of about 50 ohms; a maximum SPL (sound pressure level) of about 100 dB; self noise of about 22 dBA; a power requirement from about 8 VDC to about 18 VDC, at about 70 mA; a connector including a 3.5 mm terminal block plug with 180 degree wire-to-plug orientation, accepting 30 AWG to 14 AWG size wire; a polarity wherein positive pressure on the diaphragm corresponds to positive voltage on pin 2 or the second terminal 200; an RF immunity meeting or exceeding EN55103-2, E1, E2, E3 and E4; and RoHS (Restriction of Use of Hazardous Substances) compliance.

With reference now to FIG. 3, the microphone 40 can be installed in a wall, a ceiling, or other surfaces 60 with the microphone head 42 positioned towards the interior of the room 62. The microphone 40 can also be installed in tables, desks, cabinets, or other furniture or fixtures.

Figure 7:
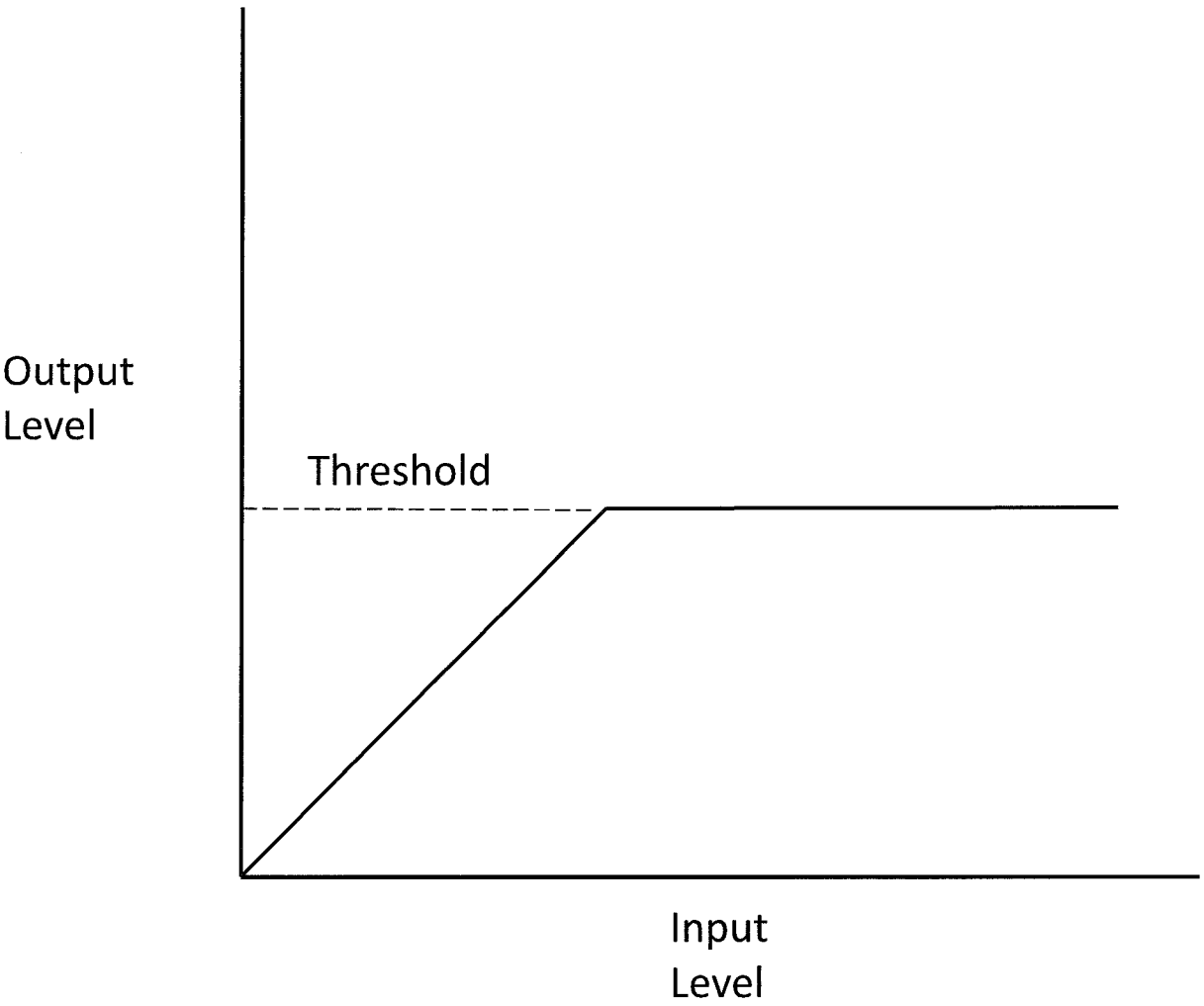
FIG. 7 is a graph of the output of a microphone versus the input of the microphone, according to one embodiment.

With reference to FIGS. 4 and 5, a microphone circuit 10 can include a capacitor microphone capsule 12, an output buffer amplifier 16, and an audio limiter or dynamic range limiter 18. In some embodiments, the microphone circuit 10 can include a capacitor microphone capsule 12, an impedance converter 14, an output buffer amplifier 16, and an audio limiter or dynamic range limiter 18. The audio limiter 18 modifies the dynamic range of the input audio signal by limiting the output signal level to a predetermined or threshold level, as shown in FIG. 7. In some embodiments, the threshold is fixed, and in other embodiments, the threshold is adjustable. If the input level exceeds a certain level, then the audio limiter 18 limits the output at the predetermined or threshold level and maintains the output at this constant level. The range of the output level can be from about a millivolt, or a few millivolts, to about 1 volt RMS.

FIG. 6 illustrates a circuit diagram of a microphone circuit 10, according to one embodiment. Although this circuit diagram is shown with values for each of the components, these values represent just one operational value for each of the components chosen from an extensive selection of operational values. Each of the components can have a variety of other values that are within the scope of this invention. In addition, many variations of this circuit diagram have been contemplated and are also within the scope of this invention.

With reference to the embodiment shown in FIG. 6, microphone capsule SV1 can be a permanently-biased microphone capsule with integrated FET impedance converter. In one embodiment, the microphone capsule SV1 can be an electret condenser microphone. Resistor R12 is a drain biasing resistor for the integrated FET impedance converter. A noise filter for the impedance converter bias voltage can include resistor R15 and capacitor C20. Capacitor C11 is a DC blocking capacitor.

A low-noise preamplifier can include U2-OA1, resistor R6, resistor R7, capacitor C9, resistor R10, and capacitor C10. The low-noise preamplifier can have a gain of about 16 dB. A high pass filter can include the combination of resistor R10 and capacitor C10. The high-pass filter can have a turnover frequency of approximately 100 Hz. Capacitor C9 limits the high-frequency response of the low-noise preamplifier. Resistor R6 biases the low-noise preamplifier.

A voltage-controlled amplifier (VCA) can include components U2A, capacitor C3, resistor R2, resistor R4, capacitor C2, and capacitor C5. In one embodiment, the VCA can have a low-level nominal gain of about 20 dB. Capacitor C2 can limit the high-frequency turnover of the VCA to approximately 22 KHz, and capacitor C3 can set the lower limit to approximately 100 Hz.

A limiter threshold detector can include components U2-OA4, resistor R1, resistor R5, resistor R9, diode D1, and capacitor C6.

An RMS detector for the limiter threshold detector can include U2B, capacitor C13, resistor R8, capacitor C1, resistor R3, and capacitor C8. Capacitor C13 sets the rectifier time constant. Capacitor C8 is a DC blocking capacitor. A low-pass filter can include the combination of resistor R3 and capacitor C1. The low-pass filter can reduce the introduction of ultrasonic signals to the limiter threshold detector.

When the RMS detector output level exceeds a set level, the output of the limiter threshold detector decreases, which reduces the gain of the voltage-controlled amplifier VCA, thus maintaining the output of the VCA to a fixed level. In some embodiments, the set level is one diode drop. In some embodiments, the fixed level is a threshold level.

Resistor R13 is the output-level control. Resistor R11 sets the lower limit or minimum output-level setting. Capacitor C14 is a DC blocking capacitor.

An output buffer amplifier can include component IC5. Resistor R14 biases the output buffer amplifier IC5. Capacitor C15 and capacitor C18 are DC blocking capacitors. Resistor R16 keeps the output-side of capacitor C18 near ground.

RF immunity can be provided by the components capacitor C22, capacitor C24, capacitor C23, capacitor C25, inductor L1, and inductor L2. X2 is the output connector. A voltage regulator can include IC1. The voltage regulator IC1 can be filtered by capacitor C16 and capacitor C17.

Numerous embodiments have been described herein. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

Having thus described the invention, it is now claimed:

1. A microphone comprising:

a microphone capsule;

a low-noise preamplifier operatively connected to the microphone capsule;

a high-pass filter operatively connected to the low-noise preamplifier;

a voltage controlled amplifier having a signal input operatively connected to a signal output of the low-noise preamplifier;

an RMS detector operatively connected to the voltage controlled amplifier;

a limiter threshold detector directly connected to the voltage controlled amplifier and the RMS detector; and an output buffer amplifier operatively connected to the voltage controlled amplifier;

wherein the output of the limiter threshold detector decreases when the output level of the RMS detector exceeds a set level, wherein the decrease in the output of the limiter threshold detector reduces the gain of the voltage controlled amplifier and maintains the output of the voltage controlled amplifier at a fixed level.

2. The microphone of claim 1, wherein the output level of the microphone is manually adjustable.

3. The microphone of claim 2, wherein the output level is adjustable from −50 dBV (3.2 mV) to −10.5 dBV (300 mV).

4. The microphone of claim 2, wherein the high-pass filter is a 150 Hz, 6 dB/oct high-pass filter.

5. The microphone of claim 1, wherein the high-pass filter is a 100 Hz, 12 dB/oct high-pass filter.

6. The microphone of claim 1, wherein the microphone has an omnidirectional polar pattern.

7. The microphone of claim 1, wherein the microphone capsule is permanently biased and includes a FET impedance converter.

8. The microphone of claim 7 further comprising a noise filter for the FET impedance converter.

9. The microphone of claim 1, wherein the low-noise preamplifier has a gain of 16 dB.

10. The microphone of claim 1, wherein the high pass filter has a turnover frequency of 100 Hz.

11. The microphone of claim 1, wherein the voltage-controlled amplifier has a low-level nominal gain of 20 dB.

12. The microphone of claim 1, wherein the voltage-controlled amplifier has a high-frequency turnover limit of 22 kHz and a lower limit of 100 Hz.

13. The microphone of claim 1, wherein:

an output of the RMS detector is connected to an input of the limit threshold detector; and an input of the RMS detector is directly connected to the low-noise preamplifier.

14. The microphone of claim 1 further comprising:

a housing that encloses the microphone capsule, the low-noise preamplifier, the high-pass filter, the voltage controlled amplifier, the RMS detector, the limiter threshold detector, and the output buffer amplifier.

15. The microphone of claim 14, wherein:

the housing is threaded on substantially all of its outer circumference along a longitudinal axis of the microphone.

16. The microphone of claim 14, wherein:

the housing is a miniature button-style housing.

17. The microphone of claim 14 further comprising:

a removable terminal block that is accessible outside the housing.

18. A method comprising the steps of:

providing a microphone comprising a microphone capsule, a low-noise preamplifier operatively connected to the microphone capsule, a high-pass filter operatively connected to the low-noise preamplifier, a voltage controlled amplifier having a signal input operatively connected to a signal output of the low-noise preamplifier, an RMS detector operatively connected to the voltage controlled amplifier, a limiter threshold detector directly connected to the voltage controlled amplifier and the RMS detector, and an output buffer amplifier operatively connected to the voltage controlled amplifier;

decreasing the output of the limiter threshold detector when the output level of the RMS detector exceeds a set level;

reducing the gain of the voltage controlled amplifier and maintaining the output of the voltage controlled amplifier at a fixed level.

19. A method of installing a microphone, comprising the steps of:

a. providing a microphone comprising:

a microphone capsule;

a low-noise preamplifier operatively connected to the microphone capsule;

a high-pass filter operatively connected to the low-noise preamplifier;

a voltage controlled amplifier having a signal input operatively connected to a signal output of the low-noise preamplifier;

an RMS detector operatively connected to the voltage controlled amplifier and having an input directly connected to the low-noise preamplifier;

a limiter threshold detector directly connected to the voltage controlled amplifier and having an input connected to an output of the RMS detector;

an output buffer amplifier operatively connected to the voltage controlled amplifier;

a housing that encloses the microphone capsule, the low-noise preamplifier, the high-pass filter, the voltage controlled amplifier, the RMS detector, the limiter threshold detector, and the output buffer amplifier; and a removable terminal block that is accessible outside the housing;

wherein the housing is a miniature button-style housing, threaded on substantially all of its outer circumference along a longitudinal axis of the microphone;

wherein the output of the limiter threshold detector decreases when the output level of the RMS detector exceeds a set level, wherein the decrease in the output of the limiter threshold detector reduces the gain of the voltage controlled amplifier and maintains the output of the voltage controlled amplifier at a fixed level;

b. installing the microphone in an associated member chosen from the group consisting of:
a wall;
a ceiling;
a table;
a desk;
an item of furniture; and
a fixture; and c. securing the microphone in the associated member by a nut.

* * * * *